US007955150B2

(12) United States Patent
Friedrich

(10) Patent No.: US 7,955,150 B2
(45) Date of Patent: Jun. 7, 2011

(54) SURFING SKIS

(76) Inventor: James Friedrich, Bolinas, CA (US)

( * ) Notice: Subject to any disclaimer, the term of this patent is extended or adjusted under 35 U.S.C. 154(b) by 750 days.

(21) Appl. No.: 11/726,566

(22) Filed: Mar. 21, 2007

(65) Prior Publication Data

US 2008/0146100 A1 Jun. 19, 2008

Related U.S. Application Data

(60) Provisional application No. 60/874,511, filed on Dec. 13, 2006.

(51) Int. Cl.
*B63B 35/83* (2006.01)

(52) U.S. Cl. ..... 441/65

(58) Field of Classification Search ..... 441/68, 441/76, 77
See application file for complete search history.

(56) References Cited

U.S. PATENT DOCUMENTS 3,479,674 A * 11/1969 Beymer ..... 441/77
3,716,881 A * 2/1973 Tilings ..... 441/77
4,129,912 A * 12/1978 Robinson ..... 441/76
4,698,039 A * 10/1987 Watson ..... 441/77
4,804,345 A * 2/1989 Lee ..... 440/21
4,915,659 A * 4/1990 Sanders ..... 441/76
5,080,621 A * 1/1992 Nayes ..... 441/77
5,429,537 A * 7/1995 Seith ..... 441/76
6,461,210 B2 * 10/2002 Lorenzo ..... 441/68

* cited by examiner

*Primary Examiner* — Ed Swinehart
(74) *Attorney, Agent, or Firm* — Bay Area Technology Law Group PC

(57) ABSTRACT

A surf ski system to enable a user to surf waves. This system includes a pair of surf skis, each surf ski being in the form of a floatation device including a floating hull, fore and aft ends, longitudinal axis connecting the fore and aft ends and a transverse axis perpendicular to the longitudinal axis. A pair of flexible connecting straps are provided connecting the pair of surf skis, each surf ski having a foot well and toe straps for receiving and partially restraining the feet of a user. One of the flexible connecting straps is located fore of the foot wells and one of the flexible connecting straps being aft of the foot wells. Each of the floatation devices has an upper surface and a lower surface and side walls for facilitating a user's ability to plane on water and a skeg extending from each lower surface, the side walls and lower surface meeting at an edge forming a hard chine there between.

1 Claim, 3 Drawing Sheets

SURFING SKIS

PRIOR APPLICATIONS

This applications claims priority to U.S. Provisional Application No. 60/874,511 which was filed on Dec. 13, 2006.

TECHNICAL FIELD

This invention relates to equipment for enabling a user to surf waves standing on two individual skis, and more particularly, to surf waves in a manner akin to skiing on snow.

BACKGROUND OF THE INVENTION

There exists in the art a variety of floatation devices intended to be used by individuals to cross over ponds, lakes, or other bodies of water while standing up. There is a long history of floatation devices designed to cross over flat water with a striding motion similar to that used to cross country ski. Typically, some type of mechanical resistance is provided to resist motion of the floatation device on the backward movement of the stride, while providing as little resistance as possible on the forward motion of the stride. The net result is a shuffling motion across the water. Connections between the individual floatation devices were designed to allow the sliding motion while keeping the skis in a usable relationship.

Many water walkers utilize deep foot wells in order to lower their centers of gravity. V-shaped hulls are often used in order to keep the water walkers upright and going in a straight direction. Poles with cups and paddles mounted on users arms are shown in the art. Even hinged hulls have been used.

Other water walking devices incorporate various accessories such as bars and clips that would be too dangerous in dealing with ocean waves.

It is therefore an object of the invention to provide skis that are adapted for surfing in ocean water.

Another object of the invention is to provide equipment allowing an individual to stand upright on two floating hulls and to ride surf waves in a manner similar to snow skiing.

A further object of the invention is to provide a pair of skis that allow an upright rider to maneuver on waves and surf.

Another object of the invention is to provide a set of floatation devices for surfing in coastal waters that allows the surfer to safely exit and remount the floatation devices after a wipeout.

SUMMARY OF THE INVENTION

A surf ski system to enable a user to surf waves. This system includes a pair of surf skis, each surf ski being in the form of a floatation device including a floating hull, fore and aft ends, longitudinal axis connecting the fore and aft ends and a transverse axis perpendicular to the longitudinal axis. A pair of flexible connecting straps are provided connecting the pair of surf skis, each surf ski having a foot well and toe straps for receiving and partially restraining the feet of a user. One of the flexible connecting straps is located fore of the foot wells and one of the flexible connecting straps being aft of the foot wells. Each of the floatation devices has an upper surface and a lower surface and side walls for facilitating a user's ability to plane on water and a skeg extending from each lower surface, the side walls and lower surface meeting at an edge forming a hard chine there between.

DETAILED DESCRIPTION OF THE INVENTION

In accordance with the present invention a pair of surf skis or surf hulls are provided that enable a user to ride ocean surf and maneuver in ocean surf in a manner similar to a combination of snow skiing and conventional surfing. By this it is meant that the rider is standing on two hulls that are maneuverable to catch and ride ocean surf.

To achieve these results a number of features are incorporated into the present pair of surf skis. First, each pair of surf hulls must float and be capable of supporting a surf rider. To get to a position to catch a wave and to then catch a wave, a paddle used by the rider provides power. One suitable style paddle is that used by kayakers. It can also be a single blade paddle or, preferably, a double blade paddle.

Short straps that, in the preferred embodiment, are provided fore and aft flexibility connect the two hulls. The flexible connectors can be made of short segments of rope or straps made, for example, of nylon.

The surf skis are designed to plane on the water surface when catching a wave. Planing is a term used by boatmen and sailors. In the Wikipedia planing is defined, in part as follows:

"Planing allows the boat to go faster by using its speed and hull shape to lift the front part of the hull out of the water. The boat travels on top of the water, greatly reducing the hydrodynamic drag on the vessel. The increase in aerodynamic drag is small by comparison."

Each of the above features help to achieve planeability of the present surf skis.

Figure 1:
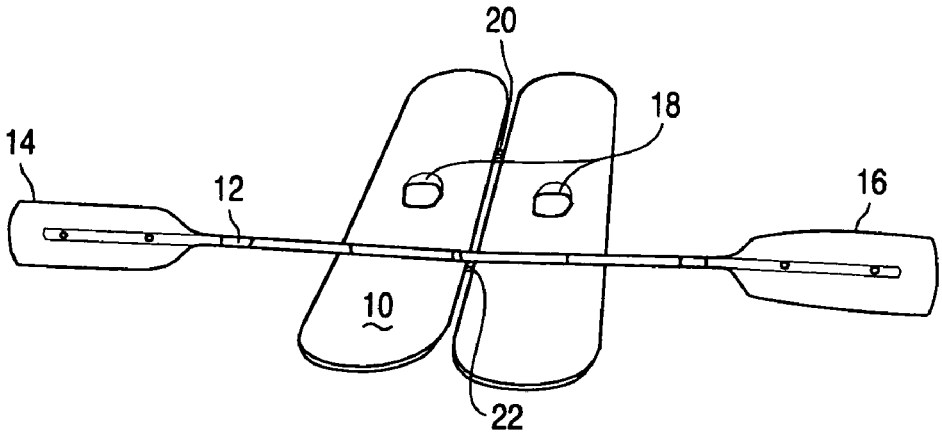
FIG. 1 is a front elevation view of a pair of surf skis and paddle in accordance with the present invention.

Turning first to FIG. 1, a pair of surf skis or surf hulls 10 and a kayak style paddle 12 with two blades 14 and 16 are shown. Each of the surf hulls is symmetrical fore and aft as well as from one side of the hull to the other.

Figure 4A:
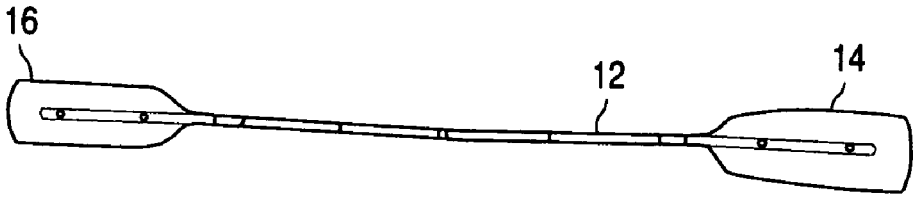
FIG. 4A is a top view of a preferred double blade paddle.
Figure 4B:
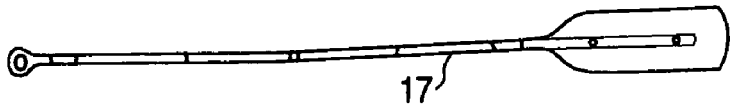
FIG. 4B is a top view of a single blade kayak paddle, used with the surf skis of the present invention.

While a paddle with two blades is preferred (see FIG. 4A) a canoe paddle 17 with a single blade, in the Hawaiian style, can also be used as shown (FIG. 4B). For an adult male rider, a double blade paddle should be in the range of six to seven feet long. It needs to be long enough so that a rider can use the paddle standing up both to propel the surf hulls as well as to use the paddle as a rudder to control movement of the surf skis.

When a rider mounts the surf skis his/her feet are placed in shallow foot wells 18 located on the top surface at the center of balance of each of the surf hulls 10. Flexible connections 20 and 22 are provided between the two surf hulls 10. These should be no more than 4" to 6". They are needed for responding to waves while maintaining a stable relationship between the hulls. As additionally shown in FIG. 3 these are made of strapping or cord. In a preferred embodiment the straps are made of nylon but they can be made of rubber, plastic, or other waterproof or water resistant materials. The flexible connections 20 and 22 are removably attached to each of the surf hulls 10 through loops of nylon anchored in the hulls as later described in reference to FIG. 6. The length of these connections is adjustable to suit the rider and the surf conditions.

Figure 2:
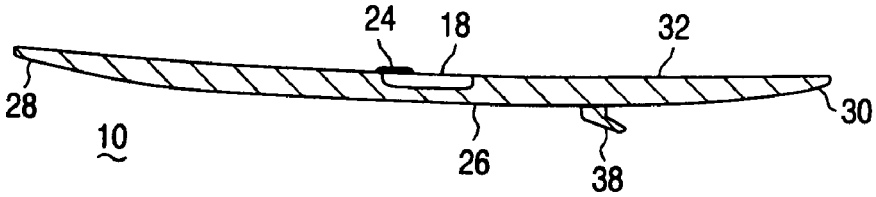
FIG. 2 is a side view of a surf ski in accordance with the invention.
Figure 3:
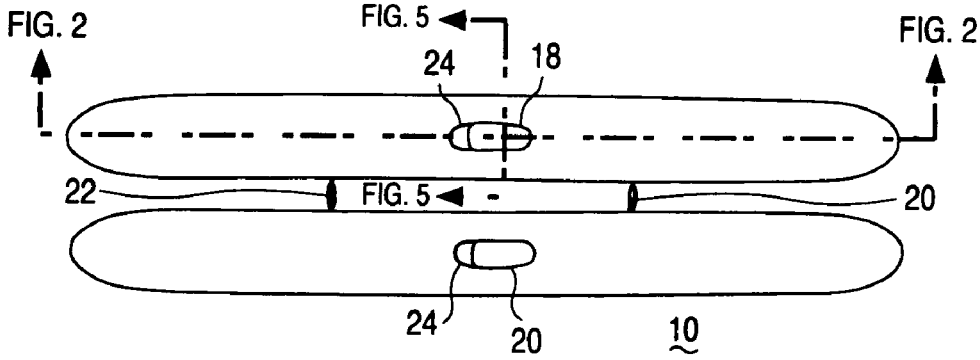
FIG. 3 is a top view of a pair of surf skis in accordance with the invention.
Figure 7:
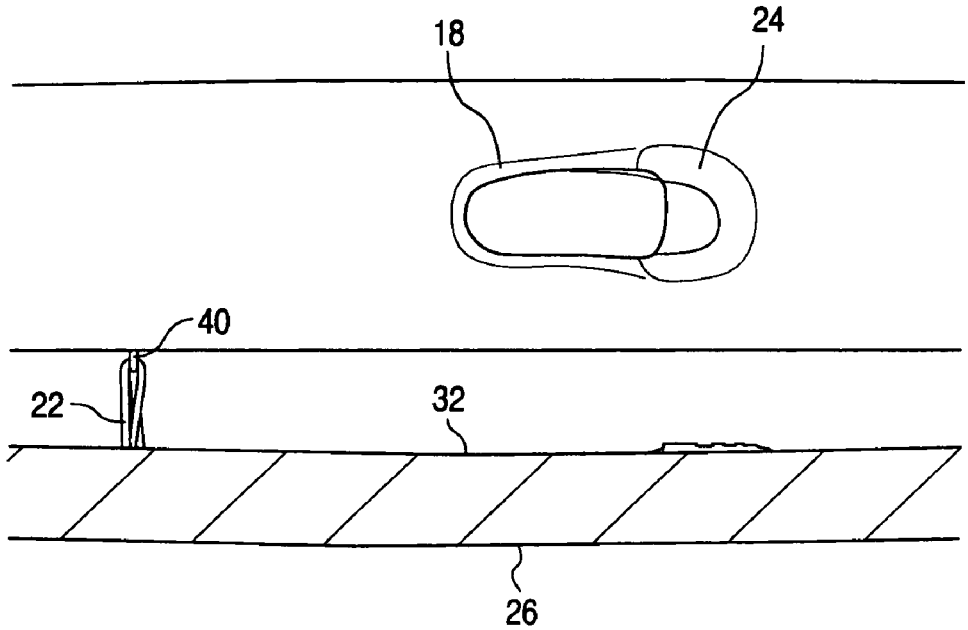
FIG. 7 is an enlarged plan and side view of surf skis illustrating the foot pocket and the flexible connector of the present invention.

FIG. 2 is a sectional side view of one of the surf hulls 10 taken along line 2-2 as indicated in FIG. 3. FIGS. 2 and 3 show foot wells 18 and 20. The foot wells are generally open except for toe strap pieces 24 located at the top front of each foot well. Each toe strap piece is located approximately flush with the top surface of each foot well and is made of a soft, flexible material such as rubber or other flexible material. The toe pieces serve to restrain the riders' feet within the foot wells while riding a wave, yet allow the surf riders' feet to come out easily during a wipeout. FIG. 7 is an enlarged view of the foot wells and toe strap as well as a view of the flexible connectors.

Referring to FIG. 2, the bottom 26 has a gentle convex shape from the bow or nose 28 to the stem 30 of surf hull 10. This helps prevent nose 28 from going below the water level when catching a wave and causing a wipeout. It also aides in achieving planing speed as the rider surfs a wave. The top surface 32 also has a gentle curve from the nose 28 to the stem 30. A skeg 38 is also provided near the stem 30 of each of the surf hulls. Skegs are well known in the surfboard art and provide directional stability while not imposing significant drag.

Figure 5:
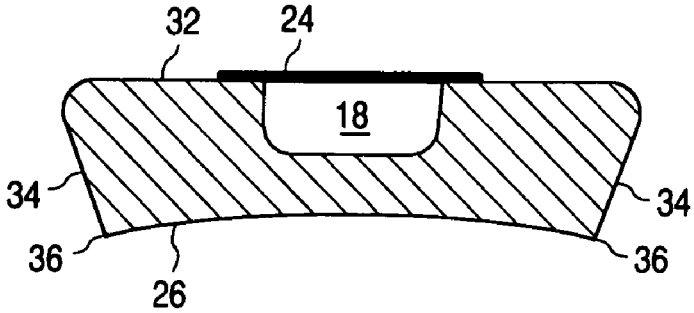
FIG. 5 is a sectional view of one surf ski taken along a line indicated in FIG. 3.

FIG. 5 is a sectional view of a surf hull 10 taken along the line 5-5 indicated in FIG. 3. As can be seen, the bottom 26 has a concave shape. This concave surface also helps to allow the surf hulls 10 to plane. The sides 34 of each surf hull are angled or tapered inwardly from the top surface 32 to the bottom surface 26. This provides additional lift while maximizing the area of the planing surface.

Figure 6:
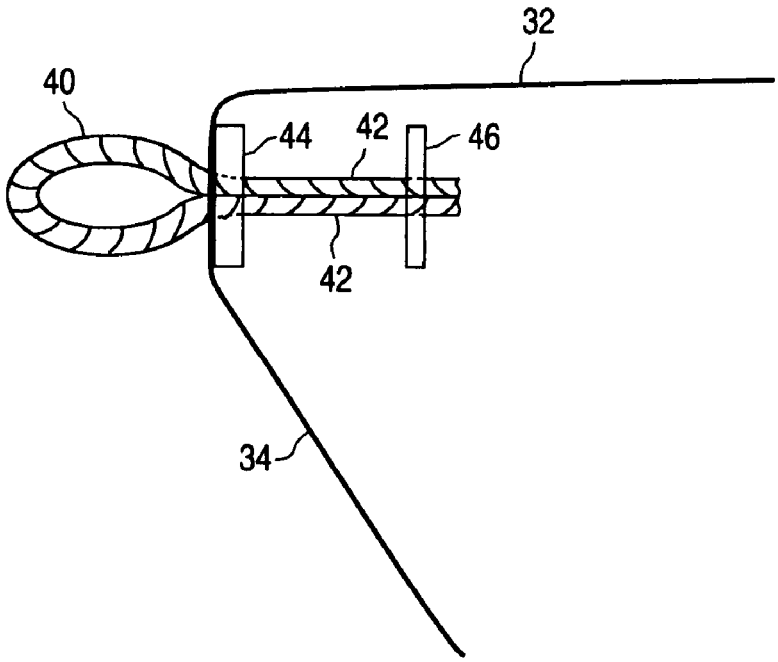
FIG. 6 is a cross-sectional view illustrating how the flexible connectors are anchored to the surf skis.

FIG. 6 shows the manner in which the flexible connectors 20 and 22 are connected with the surf hulls 10. A nylon loop 40 is anchored and embedded into the foam during fabrication of the surf skis before the fiberglass resin is applied. The foam is notched in a T-shape, removed, and the two distal ends 42 are inserted in the notch through a first washer 44 and a second washer 46 and glued in place. The remaining volume of each notch is filled in by the leftover foam or a suitable filler. Washer 46 provides the principal anchor for nylon loop 40. Washer 44 provides additional strength at the flex point of the flexible rope. The washers used in the preferred embodiment were galvanized but washers of other materials can also be used.

FIG. 7 further illustrates foot well 18. Toe strap piece 24, generally has a half-moon shape and is secure flush with top surface 32 of the surf ski. It can be secured, for example, by screws covered over with a filler or can be secured by suitable adhesive and then the secured portion is glassed over during fabrication. FIG. 7 also shows the location of nylon loop 40 to which is attached flexible connector 22.

The intersection of the tapered sides 34 and the concave-shaped bottom 26 (FIG. 5) provide a hard chine or rail or edge 36 on each side of the surf hull to cut in to the wave and help stabilize the surf hulls. A chine is the intersection between the sides and the bottom of a hull and a hard chine is one that comes substantially to a point. These rails are somewhat analogous to edges on snow skis.

Note that no mechanical flaps or cups are provided, nor any connections designed for walking or striding across water. Nor are the surf skis of the present invention provided with deep foot wells or hulls with a V-shape. This is because the surf skis of the present invention are not designed for walking or striding across flat water. Rather they are used to surf ocean waves.

The surf skis of the present invention are completely smooth with no hooks, bars or clips that could catch on the rider during dismount or during a wipeout. Surf hulls can be made from conventional materials and techniques. In a preferred embodiment the surf skis are made from foam board and provided with a fiberglass surface, as conventionally used to make surfboards. A suitable foam board is readily available polystyrene foam, and during fabrication, is covered with six ounce fiberglass cloth impregnated with epoxy resin. The surf skis fabricated in this manner are lightweight, strong and unsinkable.

Other materials can be used to make surf skis such a Kevlar. For example, they can be roto molded polyethylene plastic which is conventionally used to fabricate kayaks. They can also be made of other carbon and fiberglass based materials.

Surf skis or surf hulls 10 are mounted by a rider in shallow breakwater and then paddled out preferably standing up through breaking ocean surf. Once out to where the waves are breaking the rider orients the surf skis generally perpendicular to a wave face and, using the paddle propels the hulls forward to match the speed of the wave. Once a wave is caught, the rider can maneuver the surf skis by a combination of using the paddle as a rudder and by shifting the rider's weight by tipping the rails or edges to maneuver the surf skis.

While the size and volume of the surf skis will vary depending upon the size and weight of the rider, in an actual embodiment for use with a male rider approximately six feet tall, weight 160-170 lbs, the following parameters were used:

Length of surf hull from nose 28 to stern 30—10 feet.

Width of surf hull except for the nose and stem—1 foot.

Depth of foot wells—2 inches.

Thickness of surf hulls—4 inches.

The amount of curve of the bottom 26 from nose 28 to stem 30—approximately 2 inches over the length of 10 feet.

The amount of concavity of bottom 26—approximately ¼ inch over 10 inches between edges 36.

The angle of the sides 34 relative to the top 32—approximately 70 degrees.

Surfing skis will be made in a broad range of sizes and shapes depending on the user's size, the user's skill level, the desired performance as well as the local surf conditions.

For example, there will be shorter skis with a sharper turning radius for use on steep and breaking waves and longer skis for larger rolling waves.

"Tow-in" skis for very large waves must be adapted for higher speeds with extra length and weight, and more secure foot bindings.

"Wind surfing" skis and "kite skis" will have different requirements for size and shape as well as skeg size and positions, in order to use a "sail" or "kite" instead of a paddle for power.

What is claimed is:

1. A surf ski system to enable a user to surf waves, said system comprising a pair of surf skis, each surf ski comprising a floatation device comprising a floating hull, comprising fore and aft ends, a longitudinal axis connecting said fore and aft ends and a transverse axis perpendicular to said longitudinal axis, a pair of flexible connecting straps connecting said pair of surf skis, each surf ski having a foot well and toe strap for receiving and partially restraining the feet of a user, one of said flexible connecting straps being fore of said foot wells and one of said flexible connecting straps being aft of said foot wells, each of said floatation devices having an upper surface, a lower surface and side walls for facilitating a user's ability to plane on water, said lower surface being concave along said transverse axis, said sidewalls being tapered inwardly from said upper surface to said lower surface creating a hard chine with said lower surface said upper surface joining each of said sidewalls at an angle of approximately 70° and a skeg extending from each lower surface, said side walls and lower surface meeting at an edge forming said hard chine there between.

* * * * *